US008794152B2

(12) United States Patent
Plitt et al.

(10) Patent No.: US 8,794,152 B2
(45) Date of Patent: Aug. 5, 2014

(54) SEALER ELEMENTS, DETONATORS CONTAINING THE SAME, AND METHODS OF MAKING

(75) Inventors: Tyson J. Plitt, Barkhamsted, CT (US); Joseph W. Twarog, Jr., Barkhamsted, CT (US); Mark Dorman, North Granby, CT (US); Raymond T. Overstrom, Glastonbury, CT (US); John Childs, Shelburne, VT (US)

(73) Assignee: Dyno Nobel Inc., Salt Lake City, UT (US)

( * ) Notice: Subject to any disclaimer, the term of this patent is extended or adjusted under 35 U.S.C. 154(b) by 2 days.

(21) Appl. No.: 13/582,880

(22) PCT Filed: Mar. 9, 2011

(86) PCT No.: PCT/US2011/027639

§ 371 (c)(1),
(2), (4) Date: Jan. 2, 2013

(87) PCT Pub. No.: WO2011/112647

PCT Pub. Date: Sep. 15, 2011

(65) Prior Publication Data

US 2013/0112098 A1 May 9, 2013

Related U.S. Application Data

(60) Provisional application No. 61/311,857, filed on Mar. 9, 2010.

(51) Int. Cl.

| | |
|---|---|
| ***C06C 5/06*** | (2006.01) |
| ***F42B 3/195*** | (2006.01) |
| ***F42B 3/107*** | (2006.01) |
| ***C06C 7/00*** | (2006.01) |

(52) U.S. Cl.

CPC . *C06C 7/00* (2013.01); *F42B 3/195* (2013.01); *F42B 3/107* (2013.01)

USPC ..... 102/276; 102/277.1; 102/202.13; 102/275.3; 102/275.11

(58) Field of Classification Search

USPC ..... 102/202.13, 202.14, 257.3, 275.6, 102/275.11, 276, 277, 277.1, 277.2

See application file for complete search history.

(56) References Cited

U.S. PATENT DOCUMENTS

| | | | |
|---|---|---|---|
| 2,436,305 | A | 2/1948 | Johnson |
| 3,020,610 | A | 2/1962 | Rejdak |

(Continued)

FOREIGN PATENT DOCUMENTS

| | | |
|---|---|---|
| CL | 35552 | 1/1987 |
| DE | 3841690 A1 | 6/1990 |

(Continued)

OTHER PUBLICATIONS

Fischer, S.H., et al., "Theoretical Energy Release of Thermites, Intermetallics, and Combustible Metals", SAND98-1176C, 24th International Pyrotechnic Seminar, Monterey, California, Jul. 1998, 58 pages.

(Continued)

*Primary Examiner* — James Bergin
(74) *Attorney, Agent, or Firm* — Cantor Colburn LLP

(57) ABSTRACT

A gas-impermeable sealer element (24, 124) for a detonator or other explosive initiation device includes a non-reactive sleeve (26, 126) having a channel (28, 128) formed therein. A reactive material strip (30, 130) is sealed within the channel for transmission of an explosive's initiation signal through the sealer element (24, 124), either alone or in cooperation with transfer charges located at the input and/or output end of the non-reactive sleeve (26, 126). The reactive material strip (30, 130) comprises a reactive metal wire or other substrate (34) having on one or both sides thereof a layer of reactive material (30, 130, 36), either reactive metal foils which react exothermically when ignited, or a deposited fuel-oxidizer reactive material. The reactive materials, upon being energized, react exothermically in the absence of atmospheric oxygen or other extraneous oxidizer and so may be encapsulated, sealed or otherwise isolated from the atmosphere in use.

16 Claims, 7 Drawing Sheets

(56) References Cited

U.S. PATENT DOCUMENTS

| | | | | |
|---|---|---|---|---|
| 3,050,409 | A | | 8/1962 | Bayer |
| RE25,277 | E | | 10/1962 | Toulmin, Jr. |
| 3,089,798 | A | | 5/1963 | Rejdak |
| 3,118,798 | A | | 1/1964 | Winckler |
| 3,160,537 | A | | 12/1964 | Trafton, Jr. |
| 3,168,090 | A | | 2/1965 | Billhardt |
| 3,254,970 | A | | 6/1966 | Dittrich et al. |
| 3,322,515 | A | | 5/1967 | Dittrich et al. |
| 3,325,316 | A | | 6/1967 | MacDonald |
| 3,344,210 | A | | 9/1967 | Silva |
| 3,392,015 | A | | 7/1968 | Badia |
| 3,436,248 | A | | 4/1969 | Dittrich et al. |
| 3,489,534 | A | | 1/1970 | Levinstein |
| 3,503,814 | A | | 3/1970 | Helms, Jr. et al. |
| 3,526,953 | A | | 9/1970 | Levinstein |
| 3,560,863 | A | | 2/1971 | Baumoel |
| 3,613,589 | A | | 10/1971 | Apstein et al. |
| 3,867,265 | A | | 2/1975 | Hansson |
| 3,899,306 | A | | 8/1975 | Knopp et al. |
| 3,941,058 | A | | 3/1976 | Gawlick et al. |
| 3,989,606 | A | | 11/1976 | Kampert |
| 4,068,592 | A | | 1/1978 | Beuchat |
| 4,126,522 | A | | 11/1978 | Edlund |
| 4,239,004 | A | | 12/1980 | Day et al. |
| 4,349,612 | A | | 9/1982 | Baldi |
| 4,374,686 | A | | 2/1983 | Davitt et al. |
| 4,714,017 | A | | 12/1987 | Kelly et al. |
| 4,718,345 | A | | 1/1988 | Yunan |
| 4,741,811 | A | | 5/1988 | Lefebvre et al. |
| 4,742,773 | A | | 5/1988 | Bartholomew et al. |
| 4,840,820 | A | | 6/1989 | Schultz et al. |
| 4,848,646 | A | | 7/1989 | Morishita et al. |
| 4,989,515 | A | | 2/1991 | Kelly et al. |
| 5,015,340 | A | | 5/1991 | Colombier et al. |
| 5,031,538 | A | | 7/1991 | Dufrane et al. |
| 5,046,425 | A | | 9/1991 | Gibbons, Jr. et al. |
| 5,147,476 | A | | 9/1992 | Beck et al. |
| 5,182,417 | A | | 1/1993 | Rontey et al. |
| 5,401,596 | A | | 3/1995 | Stoilov et al. |
| 5,406,890 | A | | 4/1995 | Marsh et al. |
| 5,417,162 | A | * | 5/1995 | Adams et al. ..... 102/317 |
| 5,501,151 | A | * | 3/1996 | Thureson et al. ..... 102/275.7 |
| 5,522,318 | A | | 6/1996 | Gladden et al. |
| 5,538,795 | A | | 7/1996 | Barbee, Jr. et al. |
| 5,547,715 | A | | 8/1996 | Barbee, Jr. et al. |
| 5,623,117 | A | | 4/1997 | Lewis |
| 5,631,440 | A | * | 5/1997 | Thureson et al. ..... 102/275.7 |
| 5,721,493 | A | | 2/1998 | Paxton |
| 5,747,722 | A | * | 5/1998 | Gladden et al. ..... 102/275.11 |
| 5,843,538 | A | | 12/1998 | Ehrsam et al. |
| 5,885,321 | A | | 3/1999 | Higa et al. |
| 6,006,671 | A | | 12/1999 | Yunan |
| 6,062,143 | A | | 5/2000 | Grace et al. |
| 6,110,266 | A | | 8/2000 | Gonzalez-Blanco et al. |
| 6,178,623 | B1 | | 1/2001 | Kitazawa et al. |
| 6,192,802 | B1 | | 2/2001 | Baginski |
| 6,227,116 | B1 | | 5/2001 | Dumenko |
| 6,258,461 | B1 | | 7/2001 | Baldi et al. |
| 6,272,965 | B1 | | 8/2001 | Baginski et al. |
| 6,298,784 | B1 | | 10/2001 | Knowlton et al. |
| 6,491,766 | B1 | | 12/2002 | Baldi et al. |
| 6,534,194 | B2 | | 3/2003 | Weihs et al. |
| 6,640,719 | B1 | | 11/2003 | Pacella et al. |
| 6,692,630 | B2 | | 2/2004 | Morin et al. |
| 6,712,917 | B2 | | 3/2004 | Gash et al. |
| 6,736,942 | B2 | | 5/2004 | Weihs et al. |
| 6,780,303 | B2 | | 8/2004 | Colombier et al. |
| 6,803,244 | B2 | | 10/2004 | Diener et al. |
| 6,863,992 | B2 | | 3/2005 | Weihs et al. |
| 7,005,573 | B2 | | 2/2006 | Lionetta et al. |
| 7,026,016 | B2 | | 4/2006 | Bauer |
| 7,047,887 | B2 | | 5/2006 | Kinley |
| 7,105,740 | B2 | | 9/2006 | Allaire et al. |
| 7,146,912 | B2 | | 12/2006 | Hallin et al. |
| 7,294,411 | B2 | | 11/2007 | Wijenberg et al. |
| 7,316,186 | B1 | | 1/2008 | Robinson et al. |
| 7,446,406 | B2 | | 11/2008 | Mizuno et al. |
| 7,650,840 | B2 | | 1/2010 | Childs et al. |
| 7,951,247 | B2 | | 5/2011 | Barbee, Jr. et al. |
| 7,992,495 | B2 | * | 8/2011 | Rowe et al. ..... 102/275.3 |
| 8,066,832 | B2 | * | 11/2011 | Aube ..... 149/19.2 |
| 8,245,643 | B2 | | 8/2012 | Childs et al. |
| 2001/0002297 | A1 | | 5/2001 | Schweizer et al. |
| 2004/0031411 | A1 | | 2/2004 | Novotney et al. |
| 2005/0155752 | A1 | | 7/2005 | Larson et al. |
| 2005/0181259 | A1 | | 8/2005 | Roberge |

FOREIGN PATENT DOCUMENTS

| | | | |
|---|---|---|---|
| EP | 0487472 | A1 | 5/1992 |
| EP | 1282170 | A1 | 2/2003 |
| FR | 2626875 | A1 | 8/1989 |
| GB | 2049651 | A | 12/1980 |
| JP | 57202045 | A | 12/1982 |
| WO | 9851749 | A1 | 11/1998 |
| WO | 2004011396 | A2 | 2/2004 |
| WO | 2004106268 | A2 | 12/2004 |
| WO | 2007095303 | A2 | 8/2007 |

OTHER PUBLICATIONS

Gavens, A.J., et al., "Effect of intermixing on self-propagating exothermic reactions in Al/Ni nanolaminate foils", Journal of Applied Physics, Feb. 1, 2000, pp. 1255-1263, vol. 87, No. 3.

International Preliminary Report on Patentability for corresponding international application PCT/US11/27639, dated Jul. 2, 2012, 34 pages.

International Search Report from corresponding international application PCT/US11/27639, dated Jun. 9, 2011, 8 pages.

Prakash, A., et al., "Aero-Sol-Gel Synthesis of Nanoporous Iron—Oxide Particles: A Potential Oxidizer for Nanoenergetic Materials", Chem. Mater. 2004, 16, 1446-1471.

Written Opinion from corresponding international application PCT/US11/27639, dated Jun. 9, 2011, 7 pages.

* cited by examiner

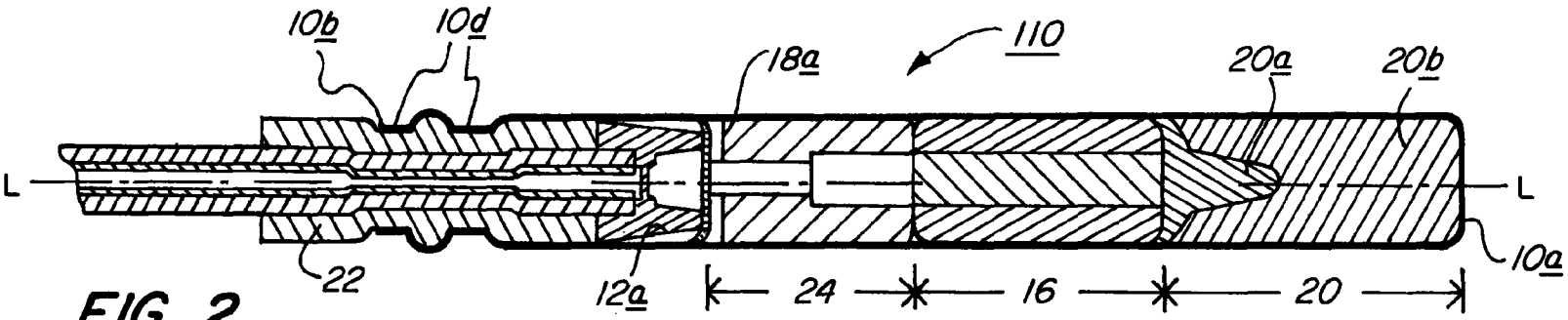
FIG. 2
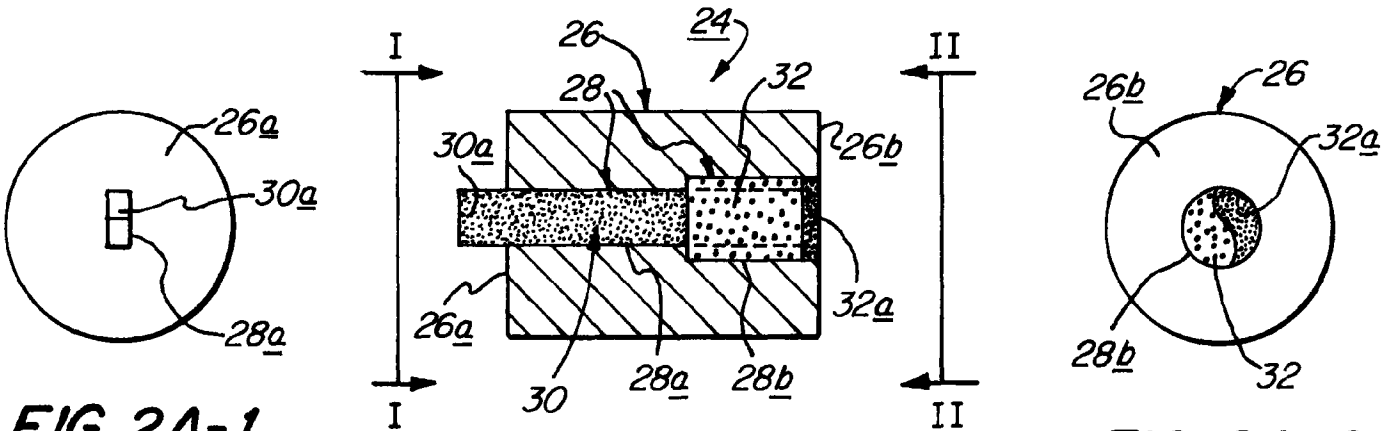
FIG. 2A-2
FIG. 2A
FIG. 2A-1

SEALER ELEMENTS, DETONATORS CONTAINING THE SAME, AND METHODS OF MAKING

CROSS-REFERENCE TO RELATED APPLICATION

This application claims the benefit of priority of provisional patent application Ser. No. 61/311,857, filed on Mar. 9, 2010, entitled "SEALER ELEMENTS, DETONATORS CONTAINING THE SAME, AND METHODS OF MAKING".

BACKGROUND OF THE INVENTION

1. Field of the Invention

The present invention relates to gas-impermeable sealer elements for pyrotechnic delay detonators and to methods of making such sealer elements. The sealer elements of the present invention comprise encapsulated reactive materials such as multilayer metal foils or wires or oxidation/reduction reaction pairs deposited on suitable substrates, or the like.

2. Description of Related Art

It is known that reactive metal foils may be utilized in a multilayered foil structure which, upon appropriate excitation, undergoes an exothermic chemical reaction to generate a significant amount of heat. U.S. Pat. No. 6,736,942, issued May 18, 2004 to T. E. Weihs et al., discloses (column 1, lines 34-44) that such multilayer foils may be used primarily as sources of highly localized (column 2, line 26 et seq.) heat for various purposes including ignition in virtually any environment including air, vacuum, water, etc. Other examples of such reactive multilayer foils are described in U.S. Pat. No. 6,863,992, issued Mar. 8, 2005 to Weihs et al. The entire disclosures of the two Weihs et al. patents are incorporated by reference herein.

Such reactive multilayer foils are fabricated by depositing onto a substrate multiple alternating thin layers of dissimilar materials, e.g., metals, by any suitable process. The dissimilar metals, e.g., nickel and aluminum, may be comprised of any materials which undergo self-sustaining exothermic reactions such as alloying of the metals, or other exothermic changes in chemical bonding, in response to being heated to an elevated (initiation) temperature. Atmospheric oxygen or other extraneous oxidizers are not required for such reactions, which are therefore referred to herein as "self-sustaining" reactions. Metallic multilayered foil laminates comprising hundreds of alternating, extremely thin layers of such dissimilar metals are commercially available from Reactive Nanotechnologies, Inc. of Hunt Valley, Md.

A product sold under the trademark PYROFUZE® is a wire manufactured by Sigmund Cohen Corp. of Mount Vernon, N.Y., and consisting of at least two metallic elements in intimate contact with each other, including arrangements of one metal as a sheath encasing the other metal, thereby providing a laminated reactive multilayer wire. A plurality of thin sheaths of alternating different reactive metals may overlie each other. As is the case with the multilayer foils, when the two metallic elements of the wire are brought to their initiation temperature, they alloy rapidly, resulting in an exothermic, rapid reaction without necessity of atmospheric oxygen or other extraneous oxidizer.

U.S. patent application publication US 2006/0236887 A1 of John Childs et al. for "Delay Units and Method of Making the Same" was published Oct. 26, 2006, and matured into U.S. Pat. No. 7,650,840 ("the '840 Patent"). The '840 Patent discloses a delay unit for detonators comprised of a timing strip 14 (FIG. 1) deposited on a substrate 12 and comprised of a reactive material which emits energy upon being heated to its initiation temperature. The energetic material, which may comprise explosive, pyrotechnic or other energy-emitting material such as a fuel and an oxidizer, may be applied to the substrate by ink compositions containing particles of the energetic material dispersed in a continuous liquid phase, and some or all of the energetic material particles may be nanosize particles. See the Abstract and col. 2, lines 43-55. The ink dries or cures to form a solid, agglomerated mass, i.e., a mass without loose particulate materials.

U.S. patent application Ser. No. 11/674,300, filed on Feb. 13, 2007, in the name of Tyson J. Plitt et al. and entitled "Delay Elements, Detonators Containing the Same and Methods of Making" ("the Plitt et al. Application"), now abandoned, discloses a delay element suitable for use in otherwise conventional detonators. The delay element comprises a substrate upon which is disposed a reactive material which may be a reactive multilayer laminate of at least two different materials, e.g., aluminum and nickel.

While the reactive materials of the '840 Patent and the Plitt et al. Application may be similar or identical to those utilized in the present invention, both the '840 Patent and the Plitt et al. Application require that the reactive material must be configured into a zig-zag, serpentine or coiled path, and/or multiple paths connected in series, in order to increase the effective travel path of the reaction and commensurately increase the time delay provided by the delay element. See, e.g., FIG. 1 of the '840 Patent and FIGS. 9 and 11 of the Plitt et al. Application.

In blasting systems, signal transmission lines, such as electrical wires, detonating cord, shock tube and the like serve as energy sources to transmit an electric or non-electric energetic initiation signal to detonators or other devices. As is well known in the art, it is often necessary to attain precisely controlled delays between receipt of the initiation signal by the detonator and initiation of the output charge of the detonator in order to effectuate the desired timing of sequential detonations in a given shot, which may contain hundreds of detonators. Typical delay periods range from 9 to 9,600 milliseconds or more, for example, 9, 25, 350, 500 and 1,000 milliseconds. In order to attain such delays, conventional pyrotechnic delay elements are disposed within the detonator between the energy source, i.e., the signal transmission line, and the output charge.

U.S. Pat. No. 5,031,538 ("the '538 Patent") discusses the problem of variations in the functioning time of pyrotechnic delay units, or failure of such delay units, citing a number of different reasons, including variations in pressure within the detonator. See the Abstract and column 1, line 63 to column 2, line 37 of the '538 Patent. The '538 Patent attempts to address the problem by providing an ignition buffer 45 (FIGS. 1 and 2) and also discloses the use of a "transition element 26" (FIG. 1) which is used to insure transmission of the input signal from the shock tube to the delay element. The transition element 26 is also intended to seal the delay element to provide a constant volume environment for burning of the delay element.

SUMMARY OF THE INVENTION

Generally, in accordance with the present invention there is provided a sealer element having an inlet (or input) end and an outlet (or output) end, the sealer element comprising a non-reactive sleeve (or plug) within which is encased a reactive material which extends in a straight line from the input to the output end and is accessible at each end for signal transfer through the sealer element. The sealer element is used in a device which also contains a pyrotechnic delay train and should contribute as little as possible to the delay time provided by the pyrotechnic delay train and provide a gas-tight seal in the device to prevent passage past the sealer element of combustion gases generated by ignition and burning of the pyrotechnic delay train, thereby controlling pressure to increase accuracy of the burn time. The reactive material reacts exothermically in a self-sustaining reaction, i.e., in a reaction which does not require the presence of atmospheric oxygen or other extraneous combustion-sustaining material and is gas-impermeable.

Specifically, in accordance with one aspect of the present invention there is provided an improvement in a sealer element for a device containing an energy source and a pyrotechnic delay train. The sealer element has an input end and an output end and comprises a strip of reactive material defining at least one reaction path extending from the input end to the output end, the reactive material being accessible to signal transfer communication at both the input end and the output end, whereby upon being energized the reactive material reacts along the reaction path to form a residual reaction product disposed along the reaction path. The improvement comprises that the reaction path defines a straight line between the input end and the output end, the reactive material comprises a solid material comprised of at least two different materials which, upon being energized, react with each other in an exothermic and self-sustaining reaction to generate the reaction product, the reaction product being impermeable to gas flow therethrough.

In accordance with another aspect of the present invention, there is provided an improvement in a sealer element for a device containing an energy source and a pyrotechnic delay train, the sealer element having an input end and an output end and being configured to be disposed within such device at a position interposed between such energy source and such pyrotechnic delay train. The sealer element comprises a strip of reactive material defining at least one reaction path extending from the input end, where the reactive material is disposed in signal transfer communication with such energy source, to the output end, where the reactive material is disposed in signal transfer communication with such pyrotechnic delay train, whereby upon ignition of the reactive material by such ignition source the reactive material reacts along the reaction path to ignite and burn such pyrotechnic delay train and to leave a residual reaction product along the reaction path. The improvement comprises that the reaction path defines a straight line between the input end and the output end, the reactive material comprises a solid material comprised of at least two different materials which, upon being energized, react with each other in an exothermic and self-sustaining reaction. The reaction product is impermeable to combustion gases generated by ignition and burning of such pyrotechnic delay train, and the sealer element is otherwise configured to provide a gas-tight seal which prevents passage of such combustion gases past the sealer element.

Other aspects of the present invention provide one or more of the following features alone or in combination of two or more. The improvement may further comprise that the reactive material comprises at least two different metals, e.g., aluminum and nickel, disposed in contact with each other and which, upon being energized by the energy source, react with each other to form an alloy of the at least two different metals; the at least two different metals may be arranged in a plurality of alternate layers of the different metals; the alternate layers may comprise a reactive multilayer foil laminate; the reactive material may comprise a solid dried or cured ink-like composition containing an intimate admixture of a particulate fuel and a particulate oxidant; the reactive material may be supported on a substrate; the sealer element may further comprises a plug encapsulating the reactive material with only end portions of the reactive material exposed at, respectively, the input end and the output end of the sealer element; the plug encapsulating the reactive material may have an output transfer charge disposed at the output end of the sealer element in signal transfer communication with the reactive material, and a portion of the reactive material may be exposed to such energy source at the input end; the plug may have an input transfer charge disposed at the input end of the sealer element and disposed in signal transfer communication with the reactive material, and an output transfer charge at the output end of the sealer element which output charge is in signal transfer communication with the reactive material; the reactive material may protrude from the output end of the sealer element to provide a protruding end of the reactive material; the protruding end may comprise a pointed, rigid end of the reactive material; and the plug may have an output transfer charge disposed at the output end of the sealer element and in signal transfer communication with the reactive material, and a portion of the reactive material may be exposed to the energy source at the output end.

Other aspects of the present invention provide that the reactive material may, as noted elsewhere herein, comprise any two or more metals which upon being heated to an elevated temperature react exothermically in a self-sustaining reaction. Suitable metal pairs are nickel/aluminum, aluminum/titanium, aluminum/cobalt, aluminum/palladium, aluminum/platinum, aluminum/ruthenium, boron/titanium and zirconium/aluminum. The most common fuels, especially for nanoenergetic materials, usable in the present invention are Al, Cu and Ag, primarily for the reasons that they are highly conductive, are relatively cheap, have proven to be safe to work with as "nanosize" (about 20 to about 1,500 nm) diameter particles, and offer good performance. Generally, fuel and oxidant reactant pairs useful as reactive materials in accordance with the teachings of the present invention are M'+MxOy, where M' is a suitable metal and M is a suitable metal different from M' and in oxide form, and x and y are positive integers, e.g., 1, 2, 3 . . . n, which may be the same or different. Both M' and MxOy are preferably capable of being reduced to nanosize particles. Suitable metal fuels, especially in nanosize particles, in accordance with the practices of the present invention include Ag, Al, B, Cu, Hf, Si, Sn, Ta, W, Y and Zr. Known nanosize thermites include stoichiometric fuel and oxidant reactant pairs listed in Table 1a of the paper *Theoretical Energy Release of Thermites, Intermetallics and Combustible Metals* by S. H. Fischer and M. C. Grubelich, of Sandia National Laboratories, Albuquerque, N. Mex. The paper, SAND-98-1176C, was presented at the 24$^{th}$ International Pyrotechnics Seminar, Monterey, Calif. in July, 1998 ("the Sandia Paper"). The following metal oxides taken from Table 3a of the Sandia Paper are among many believed to be suitable, especially in nanosize particles, for use as oxidizers in the practices of the present invention. $Ag_2O$; $Al_2O_3$; $B_2O_3$; BeO; $Bi_2O_3$; $Ce_2O_3$; CoO; $Cr_2O_3$; $Cs_2O$; $Cs_2O_3$; $CsO_2$; CuO; $Cu_2O$; $Fe_2O_3$; $Fe_3O_4$; $HfO_2$; $La_2O_3$; $Li_2O$; MgO; $Mn_3O_4$; $MoO_3$; $Nb_2O_5$; $Nd_2O_3$; NiO; $Pb_3O_4$; PdO; $Pt_3O_4$; $SiO_2$; $SnO_2$; $SrO_2$; $Ta_2O_5$; $ThO_2$; $TiO_2$; $U_3O_8$; $V_2O_5$; $WO_2$; $WO_3$; $Y_2O_3$; ZnO; and $ZrO_2$. A mixture of any of these particulate materials with any of the metals M may be dispersed in a volatile or curable liquid to provide "inks" which dry or cure to leave behind a solid agglomeration of a reactive material.

The present invention also provides for a device containing an ignition source, a pyrotechnic delay train and a sealer element interposed between the ignition source and the delay train, wherein the improvement comprises that the sealer element is a sealer element as described above.

A method aspect of the present invention provides a method of manufacturing a gas-impermeable sealer element, the method comprising the following steps. Encapsulating within a non-reactive plug having an input end and an output end a solid reactive material comprising at least two different materials which, upon being energized, react with each other in an exothermic and self-sustaining reaction. The reactive material is disposed in a reaction path (a) defining a straight line from the input end to the output end of the sealer element, and (b) being accessible to signal transfer communication at both the input and output ends of the sealer. The exothermic and self-sustaining reaction produces a residual reaction product which is gas-impermeable.

Other method aspects include one or more of the following steps, alone or in any combination of two or more steps. The plug may be configured to be inserted into a device to provide a gas-tight barrier within such device; the method may further comprise the step of disposing the reactive material on a substrate to form a reactive strip; providing the plug with a longitudinal passage therethrough, the passage opening at one end to the input end of the plug and the other end to the output end of the plug; and inserting the reactive strip into the passage with the reactive strip accessible to signal transfer at each of the input and output ends of the sealer element; a transfer charge may be inserted at the input end of the plug in signal transfer relationship with the reactive strip, with the transfer charge being accessible to signal transfer to initiate the transfer charge; providing in at least one end of the passage a chamber configured to receive therein a transfer charge in signal transfer communication with the reactive strip, and inserting a transfer charge into the chamber; and providing the chamber only at the input end of the plug.

BRIEF DESCRIPTION OF THE DRAWINGS

FIG. 2A is a longitudinal cross-sectional view, enlarged relative to FIG. 2, of the sealer element of the detonator of FIG. 2;

FIGS. 2A-1 and 2A-2 are views taken, respectively, along lines I-I and II-II of FIG. 2A;

FIGS. 3A-1 and 3A-2 are views taken, respectively, along lines I-I and II-II of FIG. 3A;

FIGS. 5A-1 and 5A-2 are views taken, respectively, along lines I-I and II-II of FIG. 5A;

FIGS. 7A and 7B are views taken, respectively, along lines A-A and B-B of FIG. 7.

DETAILED DESCRIPTION OF THE INVENTION

Figure 1:
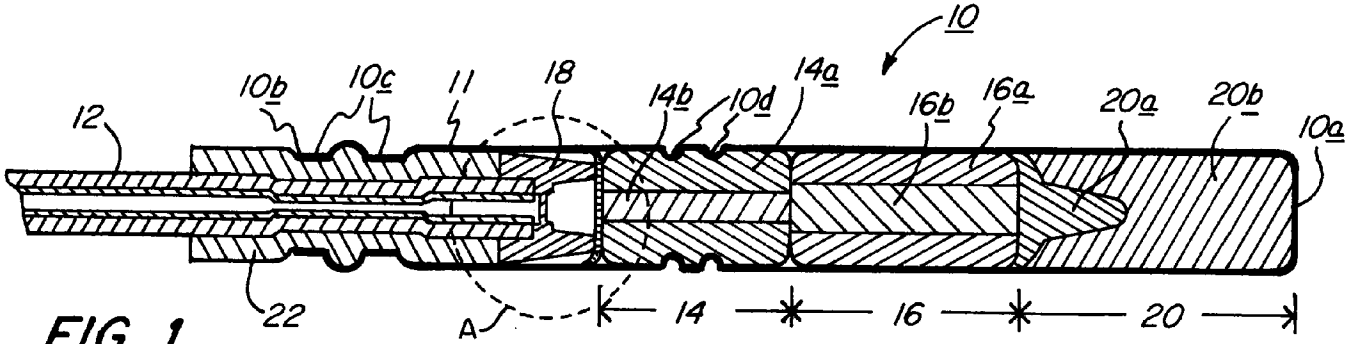
FIG. 1 (PRIOR ART)
FIG. 1 is a schematic longitudinal cross-sectional view of a conventional pyrotechnic delay detonator including a sealer element and an ignition buffer, both in accordance with the prior art.
Figure 1A:
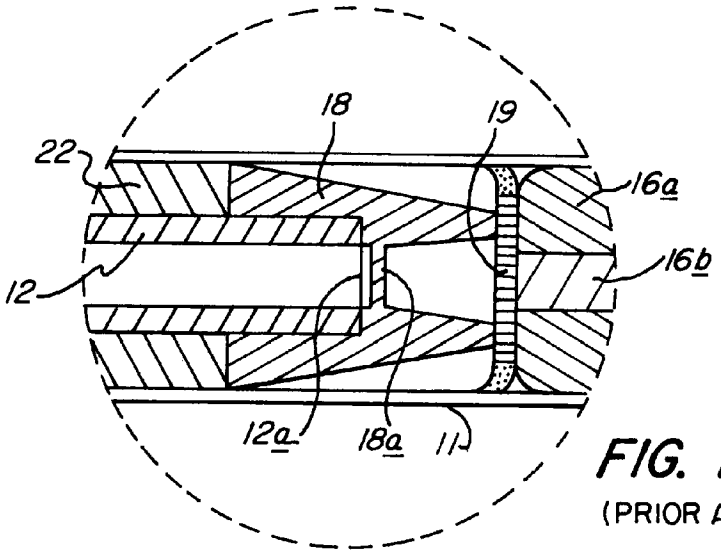
FIG. 1A (PRIOR ART)
FIG. 1A is a view, enlarged relative to FIG. 1, of approximately the portion of the prior art structure of FIG. 1 which is enclosed by circle A.

The term "metals" includes, in addition to the metals, alloys of the metals, for example, aluminum alloys containing at least 50% by weight aluminum, and nickel alloys containing at least 50% by weight nickel.

The term "reactive material strip" refers to a substrate on which is disposed any suitable reactive material, for example, a reactive material comprised of an oxidation/reduction reaction pair or a reactive multilayer laminate.

The term "signal transfer relationship" used with respect to two members being in such relationship, or variations of the term, mean that an initiation signal is transferred from one member, e.g., a shock tube or electrical wires, to the other member, e.g., a reactive material strip.

The term "agglomerated solid" means a material which is substantially free of loose particulate matter susceptible to being dislodged by signal transfer to the agglomerated solid.

The reactive material, both prior to and after its reaction, comprises a solid or agglomerated material which does not have loose particulates which can be susceptible to being dislodged by the "spit" of energy input to energize the reactive material. The reactive material is gas-impermeable both prior to reaction of the reactive material as well as afterwards.

The reactive material may comprise one or more strips of reactive material deposited on a substrate, which reactive material, upon being heated, ignited or otherwise initiated, will undergo an exothermic, self-sustaining reaction, i.e., the presence of atmospheric oxygen or other extraneous oxidizer (an oxidizer which is not a component of the reactive material itself) is not required. Such reactive material may comprise nanosize or microsize diameter particles of fuel and oxidizer materials. A wide range of such materials is disclosed in the aforesaid U.S. patent publication 2006/0236887 A1.

Generally, the reactive material comprises a gas-impermeable member (an "impermeable reactive member") which protrudes from one or both of the input and output ends of the gas-impermeable and non-reactive sleeve (or plug) to thereby expose the reactive material at one or both the input and output ends of the sealer element. The impermeable reactive member may stop short of protruding from one or both of the input and output ends of the sealer element to protect the ends of the impermeable reactive member during handling and manufacture. In such case, the end or ends of the sealer element within which the impermeable reactive material is recessed ("the recessed end" or the "recessed ends") may have a transfer charge positioned in the non-reactive sleeve. Such transfer charges are exposed to initiation from exteriorly of the sealer element and are in signal-transfer communication with the adjacent encased end of the impermeable reactive material.

The term "reactive multilayer laminate" refers to reactive metal foils or reactive metal wires and the like. The reactive multilayer laminates of the present invention comprise at least two different materials, e.g., at least two metals in a pre-alloyed state, between or among which an exothermic self-sustaining alloying reaction can be initiated by thermally energizing the reactive material. Such thermal energization may be carried out by having an energetic input initiation signal impinge on the reactive multilayer laminate. The energetic initiation signal may be heat from a source such as a flame or spark or a shock wave, friction, laser, high-intensity light or other source of energy input, for example, an electrical spark or the output signal (sometimes referred to as the "spit") of a shock tube or deflagration tube. The energetic initiation signal need contact the reactive multilayer laminate only at a starting point and raise the temperature at that point sufficiently to initiate the alloying reaction. Reactive metal foils are usually disposed on one or both sides of a substrate such as a thin sheet of metal or a sheet of plastic (synthetic polymer) material. Various metals such as tin, brass, copper, steel and the like may be used for the metal substrates. Aluminum and aluminum alloys are, however, preferred because of low cost, good adherence of the multilayer laminates to the aluminum, and the ease with which the aluminum can be cut, stamped or otherwise shaped.

Generally, as used herein, a "sealer element" refers to a non-reactive sleeve or plug which encases a reactive material while leaving opposite ends of the reactive material accessible to initiation at one end of the sealer element and generation of an output signal at the other end of the sealer element. A sealer element may comprise a transfer charge at one or both ends, to better ensure signal transfer from the energy source, e.g., an input signal transmission line, to the sealer element and/or signal transfer from the sealer element to the output charge of a detonator or to another device. Optionally, the transfer charges may comprise nanosized or micron-sized particles of reactive materials. In some embodiments, sealer elements are employed in initiators, including detonators, and are optionally configured to fit within and seal a standard initiator shell such as a detonator shell. A standard detonator shell is a cylindrical shell having an interior diameter of about 0.26 inches (about 6.6 millimeters ("mm")). A typical cylindrical sealer element may be at least about 7 mm long measured linearly from end to end and may be about 7 mm or less in diameter. Obviously, any suitable length and width dimensions may be employed. The non-reactive sleeve of the sealer element is configured to fit snugly within a detonator shell and may optionally be made of a compressible material so that the non-reactive sleeve may be force-fit or interference-fit in a detonator shell. Generally, the non-reactive sleeve is configured to form a gas-tight seal between it and the interior of the detonator shell, thereby preventing escape of combustion gases past the sealer element.

The reactive material of the reactive material strip may comprise a substrate upon which a very thin reactive metal foil is deposited on one or both sides in a straight line between the input and output ends of the reactive material strip. The thickness of each individual layer in the reactive metal foil is measured in nanometers and such layers are sometimes referred to herein as "nano-layers". The thickness of each individual layer is desirably from about 10 to about 200 nanometers ("nm"), for example, from about 10 to about 100 nm, or from about 30 to about 80 nm. The reactive material may comprise from about 20 to about 1,000 composite layers. Composite layers are layers of two or more reactive materials, e.g., bi-layers of nickel and aluminum. The entire travel path of the reactive material, except for that portion, if any, which protrudes from the input or output ends of the sealer element, is enclosed within a surround comprised of the non-reactive sleeve or plug, which overlies and is in sealing contact with both the reactive material and the reacted residue of the reactive material.

Alternatively, the reactive material of the reactive material strip may comprise a reactive material which is deposited, for example, by being printed or otherwise applied to a substrate in a straight line between the input and output ends of the reactive material strip. As disclosed in the aforesaid U.S. patent publication 2006/0236887 A1, such reactive materials may comprise any of a wide range of reactive materials, including fuel/oxidizer combinations. For example, the fuel may comprise metals such as aluminum, copper, silver, molybdenum, tungsten, titanium, silicon, and boron, and the oxidizer may comprise metal oxides such as those having the formula $M_xO_y$, where M is a metal different from the metal of the fuel and x and y are positive integers, for example, 1, 2, 3 . . . n, which may be the same or different. Any other suitable fuel-oxidizer combinations may be used; many such are known in the art. Both the fuel and oxidizer may be in the physical form of very fine "nanosize" or micron-size diameter particles (e.g., about 20 to about 1,500 nanometers in diameter) as described in paragraph 0026 of publication 2006/0236887 A1, both to enhance intimate mixing of fuel and oxidizer particles to promote reaction between them, and to facilitate incorporation of the particles into a printable or otherwise depositable ink or the like. Because these reactive materials include an oxidizer, upon being initiated, they provide a self-sustaining reaction which, like the reactive metal foils, does not require the presence of oxygen or other extraneous oxidizer. Therefore, the desired exothermic reaction will take place with any of the reactive materials of the present invention encased or sealed within a sleeve or surround and isolated from the atmosphere.

The two or more different materials of the reactive material may comprise pairs selected from the group consisting of one or more of aluminum/titanium, aluminum/cobalt, aluminum/palladium, aluminum/platinum, aluminum/ruthenium, boron/titanium, zirconium/aluminum and nickel/aluminum. Suitable materials for a reactive material may include elemental metals, silicides, aluminides (including Ni/Al), borides, carbides, thermite reacting compounds, alloys, metallic glasses, and composites.

In another embodiment, the reactive material of the reactive material strip may comprise a metal wire coated with or comprising one or more alternating layers of two or more metals which are reactive with one another to provide, upon being heated to a sufficiently high temperature, the desired exothermic, self-sustaining reaction. For example, an aluminum wire may be coated with alternating layers of nickel and aluminum or the wire may comprise a heterogeneous mixture of reactive metals such as aluminum and nickel. Two or more metal wires may be twisted, braided, or otherwise entangled together to form a "cord" or "rope" in order to provide a heavier per unit length reactive material having a higher caloric output. Regardless of how formed, the resulting reactive metal wire then may be used as the reactive strip of the sealer element, usually without need of a substrate, to define a straight reactive path from the input to the output ends of the sealer element. The wire or braid is enclosed in a plastic jacket or surround which provides the non-reactive sleeve. Alternatively, a pair of half-round rods of non-reactive material sleeves may be joined together to enclose the reactive material with the half-round rods enclosed in a suitable sheath.

In all cases, the reactive materials are selected so that the reaction product of the exothermic, self-sustaining reaction is gas-impermeable. For example, a nickel/aluminum reactive material results in the formation of a nickel aluminum alloy. Such multilayer reactive materials have a very rapid rate of reaction so that the time period for travel of the reaction between the input and output ends of a typical-sized sealer element of the invention is negligible, e.g., about 1 to 5 milliseconds, and may be considered to be near zero when calculating the overall delay time of the detonator or other device in which the sealer element is used.

A spark or other energy input will initiate a highly exothermic reaction in the reactive metal foil or wire to form a metal alloy, e.g., nickel aluminide. Similarly, a spark or other energy input will initiate the printed or otherwise deposited strand of metal-metal oxide reactive material. In all cases, the reaction is self-sustaining; that is, oxygen is not required to support the reaction and therefore the reactive multilayer laminate or deposited reactive material may be used in oxygen-free environments, e.g., encased within a suitable extruded or molded plastic, epoxy or other potting material. In either case, the products of reaction are preferably neither toxic nor environmentally hazardous. For example, the nickel aluminide reaction product is neither toxic nor environmentally hazardous.

In one embodiment, a reactive metal foil comprises alternate layers of two different reactive metals, e.g., aluminum and nickel, each layer having a thickness of about 10 nanometers ("nm") to about 200 nm. There may be from 300 to 700 or more, e.g., up to 1,000, alternating layers of nickel and aluminum on one or both sides of the substrate; the total thickness of the layers in the reactive multilayer laminate may be from about 10 to about 100 μm, e.g., from about 30 to about 80 μm, total thickness. At 30 μm thickness there might be, for example, 700 alternating nickel and aluminum layers. At a 50 μm thickness of the laminate foil, there might be a thousand such layers. Reactive metal foils thinner than about 10 μm would have a very limited caloric output and those thicker than about 100 μm might be economically unfeasible for many uses. Generally, thicker metal nano-layers are more expensive, have a higher caloric output, and slow down the reaction propagation rate (the speed of travel of the reaction) as compared to thinner metal nano-layers, which increase the reaction propagation rate. The velocity of the reaction in a particular multilayer laminate may be about 1 to about 10 meters per second (m/s). In one embodiment, the aluminum and nickel layers may have a thickness ratio of 3:2, aluminum layer to nickel layer.

FIG. 1 shows a prior art delay detonator 10 (as shown in FIG. 1 of the aforesaid U.S. Pat. No. 5,031,538) comprising a shell 11 having a closed end 10*a* and an opposite, open end 10*b*. Line L-L shows the longitudinal center axis of detonator 10. A signal transmission line comprising, in the illustrated embodiment, a shock tube 12, has a terminal end 12*a* which terminates within the shell 11 of detonator 10 adjacent a conventional sealer element 14. Sealer element 14 is comprised of a hollow metal tube 14*a* within which is disposed a column of compressed pyrotechnic delay material 14*b*. The output end of pyrotechnic material 14*b* is disposed in signal transfer relationship, e.g., in physical contact with the pyrotechnic delay material 16*b* of delay element 16.

A crimp 10*d* in shell 11 holds sealer element 14 in place and helps to prevent leakage of reaction product gas around the exterior of sealer element 14. Delay element 16 is of conventional design and comprises a hollow metal tube 16*a* within which is disposed a column of compressed pyrotechnic delay material 16*b*, the length and composition of which determine the delay period. In turn, the output end of delay element 16 is disposed in signal transfer relationship, e.g., in physical contact with, an output explosive charge 20 which is comprised of the usual initiating charge 20*a*, e.g., lead azide, and a main output charge 20*b*, e.g., pentaerythritoltetranitrate ("PETN") located at the closed end 10*a* of detonator 10. A conventional anti-static cup 18 provides a thin, easily rupturable membrane 18*a* between terminal end 12*a* of shock tube 12 and sealer element 14. An ignition buffer 19 is positioned between anti-static cup 18 and the input end of sealer element 14. Ignition buffer 19 may comprise a wire cloth screen or any other suitable foraminous and non-combustible material, provided it does not react with the pyrotechnic material 14*b* against which it is pressed. Ignition buffer 19 has a sufficient number of appropriately sized openings to permit the spit or signal from shock tube 12 to initiate the column of pyrotechnic material 14*b* while yet retaining the pyrotechnic material 14*b* within sealer element 14. Ignition buffer 19 prevents separation of the material 14*b* in the event of a sudden depressurization due to rupture or ejection from the shell 11 of shock tube 12. Ignition buffer 19, as explained in more detail at column 4, line 50 et seq. of U.S. Pat. No. 5,031,538, essentially acts as a filter, controlling the rate at which pressure is applied to the material of pyrotechnic column 14*b* and avoiding or minimizing disruption of the material 14*b* by ignition and any depressurization which may occur. A bushing 22 encloses the open end 10*b* of detonator 10 and helps to secure shock tube 12 to detonator 10. A crimp 10*c* formed in shell 11 secures bushing 22 in place.

The pyrotechnic material 14*b* of sealer element 14 is selected to leave, after it is functioned, an ash or residue which is as gas-impermeable as is feasibly consistent with the other requirements of pyrotechnic material 14*b*. For example, material 14*b* desirably burns much more rapidly than pyrotechnic material 16*b* of delay element 16 so that the delay in initiation of output explosive charge 20 imposed by sealer element 14 is as small as possible compared to the burn time of delay element 16. Pyrotechnic material 14*b* is also selected to leave a residue or ash after ignition which is as glassy, i.e., non-porous, as possible in order to reduce and, ideally, eliminate, leakage of combustion gases generated by the reaction of pyrotechnic column 16*b*, in an attempt to maintain a substantially constant effective volume for the reaction. Conventional sealer elements are, however, not ideal. The function times are often not negligible with respect to the function time of the delay element for many types of detonator fuses. Further, the seal provided is not perfect, as some leakage through the core containing the ash or residue resulting from combustion of the pyrotechnic of the sealer element takes place. In addition, gas leakage between the outer diameter of the metal tube comprising the sealer element and the inside wall of the detonator shell may also take place. In an attempt to ameliorate the latter shortcoming, sometimes an additional crimp is formed in the detonator shell around the sealer element, as shown by the crimps 56 in FIG. 1 of the above-mentioned U.S. Pat. No. 5,031,538 and by crimps 10*d* in FIG. 1 of the appended drawings. In addition, as described above, an ignition buffer (item 45 in FIGS. 1 and 2 of the '538 Patent) may be required in prior art devices. The structure of the sealer element of the present invention, as described below, does not expose a pulverulent or particulate material to the ignition spit or spark, thus doing away with the prior art need for an ignition buffer.

Unlike the delay elements of the '840 Patent and the Plitt et al. Application described above, it is desired that the sealer element impose as little delay as possible in transference of the detonation signal, e.g., from a fuse to the explosive output charge of a detonator. Therefore, the present invention provides travel paths for the reactive material which preferably are as short as is feasible for the device in which the sealer element is used. This is because it is desired that the time delay of the detonator or other device in which the sealer is used be essentially determined by the pyrotechnic delay train in the device.

Figure 3:
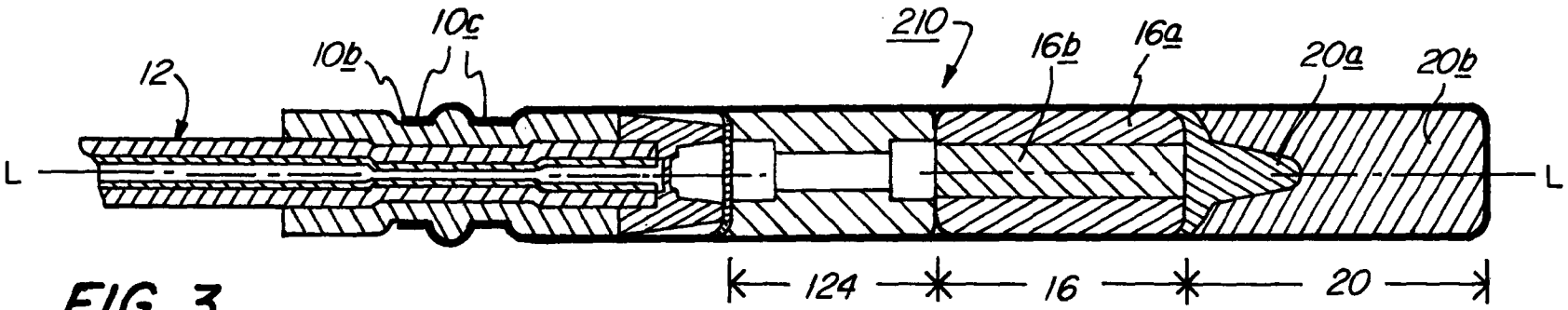
FIG. 3 is a schematic longitudinal cross-sectional view of a pyrotechnic delay detonator including a sealer element in accordance with a second embodiment of the present invention.
Figures 2, 3A:
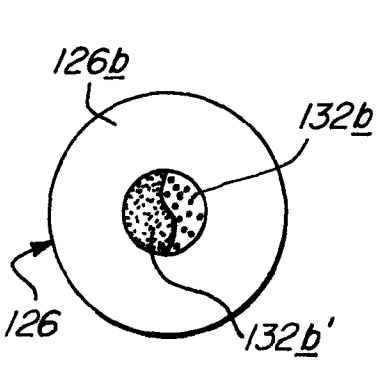
FIG. 2 is a schematic longitudinal cross-sectional view of a pyrotechnic delay detonator including a sealer element in accordance with one embodiment of the present invention.
FIG. 3A is a longitudinal cross-sectional view, enlarged relative to FIG. 3, of the sealer element of the detonator of FIG. 3.
Figure 3A:
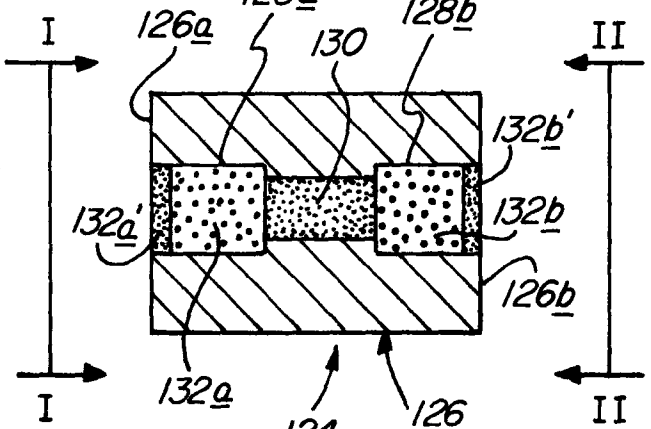
Figures 1, 3A:
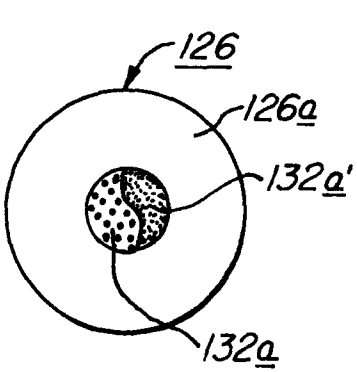
Figure 5:
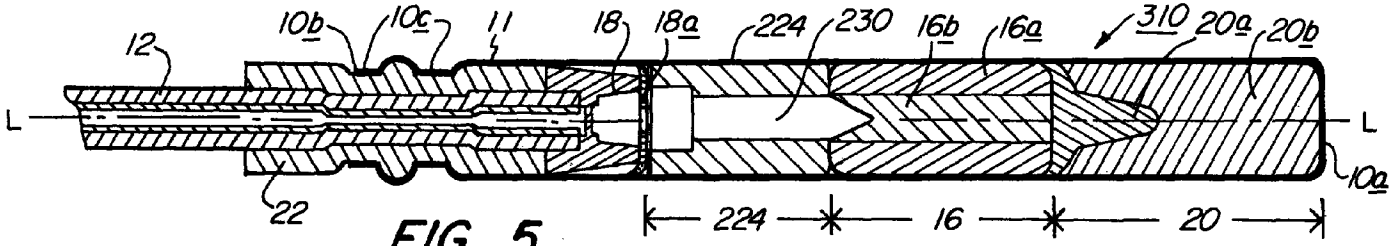
FIG. 5 is a schematic longitudinal cross-sectional view of a pyrotechnic delay detonator including a sealer element in accordance with a third embodiment of the present invention.

Detonator 110 of FIG. 2, detonator 210 of FIG. 3 and detonator 310 of FIG. 5 are identical in construction to the prior art detonator 10 of FIG. 1 except for the substitution of embodiments of the sealer element of the present invention for conventional sealer element 14 of FIG. 1, and the consequent elimination of certain design features required in the prior art detonator. In FIGS. 2, 3 and 5, as in FIG. 1, the center longitudinal axis of each of detonators 110, 210 and 310 is indicated by dot-dash line L-L. The parts of detonators 110 (FIG. 2), 210 (FIG. 3) and 310 (FIG. 5) which are identical to those of the prior art detonator 10 of FIG. 1 are numbered identically to their numbering in FIG. 1 and are not further described except in their relation to the novel sealer elements of the present invention. It will be noted that as compared to the prior art detonator 10 of FIG. 1, the sealer element 24 of the present invention eliminates the necessity in detonators 110, 210 and 310 for a delay ignition buffer and for crimps in the shell around the sealer element.

As best seen in FIGS. 2 and 2A, sealer element 24 is comprised of a cylindrical, non-reactive sleeve 26 having a channel 28 (FIG. 2A) formed therein within which a reactive material strip 30 (FIG. 2A) is encased and disposed in signal transfer relationship, e.g., in contact with, a transfer charge 32 (FIG. 2A). Reactive material strip 30 may comprise a substrate having reactive material disposed on one or both sides thereof.

Non-reactive sleeve 26 is made of any suitable gas-impermeable material such as a synthetic polymer ("plastic") or rubber material and has an outside diameter which is sized so that sealer element 24 may be force-fit within shell 11 of detonator 110 to provide a gas-tight seal therein. Crimp 10*c* of the prior art embodiment will not usually be needed to retain force-fit, non-reactive sleeve 26 in place within shell 11, as a gas seal. Non-reactive sleeve 26 has an input face 26*a* and an opposite, output face 26*b* and a channel 28 extending entirely therethrough to provide an opening at both the input face 26*a* and output face 26*b* thereof. Channel 28 has a strip section 28*a* which, as best seen in FIG. 2A, is rectangular in cross-sectional view. Strip section 28*a* of channel 28 may be slightly smaller in cross-sectional dimensions than reactive material strip 30 so that reactive material strip 30 may be force-fit when inserted through strip section 28*a*. Reactive material strip 30 may comprise a substrate, e.g., a metal substrate such as aluminum, on which extremely thin coating(s) of any suitable reactive material in accordance with the present invention is/are disposed on one or both sides of the substrate. The reactive material may be covered with a protective over-layer to protect the reactive material during handling, insertion through strip section 28*a*, etc. In any case, reactive material strip 30 is firmly encased within strip section 28*a* of channel 28 and seals strip section 28*a* against gas flow therethrough. Charge section 28*b* of channel 28 may, as best seen in FIG. 2A-2, be circular in cross section in order to receive therein a transfer charge 32 (FIG. 2A). Transfer charge 32 may be secured in place by a seal 32*a*, as more fully described below.

The manufacture of detonator 110 may be carried out in the usual manner, in which output explosive charge 20 is emplaced within shell 11 of the detonator at the closed end 10*a* thereof. A delay element 16 is then inserted within detonator 110 followed by sealer element 24 which is positioned with transfer charge 32 thereof aligned with column 16*b* of the pyrotechnic material of delay element 16. Charge 32 is thus disposed in signal transfer relationship with column 16*b*, and may be in abutting contact therewith. Reactive material strip 30 has a rectangular input end 30*a* which protrudes outwardly beyond input face 26*a* of non-reactive sleeve 26. An anti-static cup 18 or other anti-static device such as a semiconductive tape or coating applied to the interior of shell 11 is positioned between the terminal end 12*a* of shock tube 12 and sealer element 24. The terminal end 12*a* of shock tube 12 is disposed in signal transfer relationship with reactive material strip 30. A conventional bushing 22 encloses the end of shock tube 12 in the usual manner and is crimped in place at crimp 10*c* to securely retain shock tube 12 in position within detonator 110 and to close the open end of shell 11.

In use, an initiation signal is ignited in shock tube 12 in the usual manner and leaves terminal end 12*a* to penetrate the thin membrane portion 18*a* and initiate the input end 30*a* of the reactive material strip 30. The resulting self-sustaining, exothermic reaction rapidly travels along material strip 30 through the sleeve 26 to initiate transfer charge 32 which in turn initiates delay element 16 and then output explosive charge 20. The ability of the reactive material carried on reactive strip 30 to react exothermically even though confined and essentially sealed within non-reactive sleeve 26 enables transfer of the signal to output explosive charge 20 while sealer element 24 maintains a gas-impermeable seal. This maintains a constant volume within hollow metal tube 16*a* during combustion of the pyrotechnic column 16*b*. When the reactive material of reactive material strip 30 comprises a reactive multilayer laminate, whether as reactive metal foils or wires, the product of the reaction is a metal alloy, so integrity of the gas seal is not compromised. Similarly, when the reactive material comprises a fuel-oxidizer mixture, the product of reaction is an extremely thin, non-porous residue, which also maintains gas-impermeable integrity of the sealer element 24.

Referring now to FIGS. 3 and 3A, detonator 210 is identical to detonator 110 of FIG. 2 except that it contains a sealer element 124 which differs from the sealer element 24 of FIGS. 2 and 2A in that it contains two transfer charges instead of one. In detonator 210, reactive material strip 130 connects an input transfer charge 132*a* to an output transfer charge 132*b*. Reactive material strip 130 may be identical to reactive material strip 30 of FIG. 2A. That is, the reactive material thereon may be a reactive multilayer laminate or a printed fuel-oxidizer strip or any other suitable self-sustaining reactant and may be disposed on one or both sides of the substrate. In this case, as seen in FIG. 3A, non-reactive sleeve 126, which has an input face 126*a* and an output face 126*b*, has formed therein a channel 128 which has an input section 128*a* and an output section 128*b*, each of which is cylindrical in cross section, as seen in FIGS. 3A-1 and 3A-2. Input section 128*a* and output section 128*b* of channel 128 may be connected by a rectangular slit or rectangular channel (unnumbered) through which reactive material strip 130 is moved in order that reactive material strip 30 connects sections 128*a*,

128*b*, and the transfer charges contained therein, to each other in signal transfer communication.

In use, the signal generated in shock tube 12 travels to terminal end 12*a* thereof (FIG. 3) and initiates input transfer charge 132*a* (FIG. 3A) which in turn initiates reactive material strip 130, which in turn initiates output transfer charge 132*b* to initiate delay element 16, which in turn initiates output explosive charge 20. Even if the reaction residues of transfer charges 132*a*, 132*b* do not provide a perfect gas seal, the reaction residue of reactive material strip 130 does, as it comprises a metal substrate and a thin coating of a solid, non-porous reaction residue.

Figure 4:
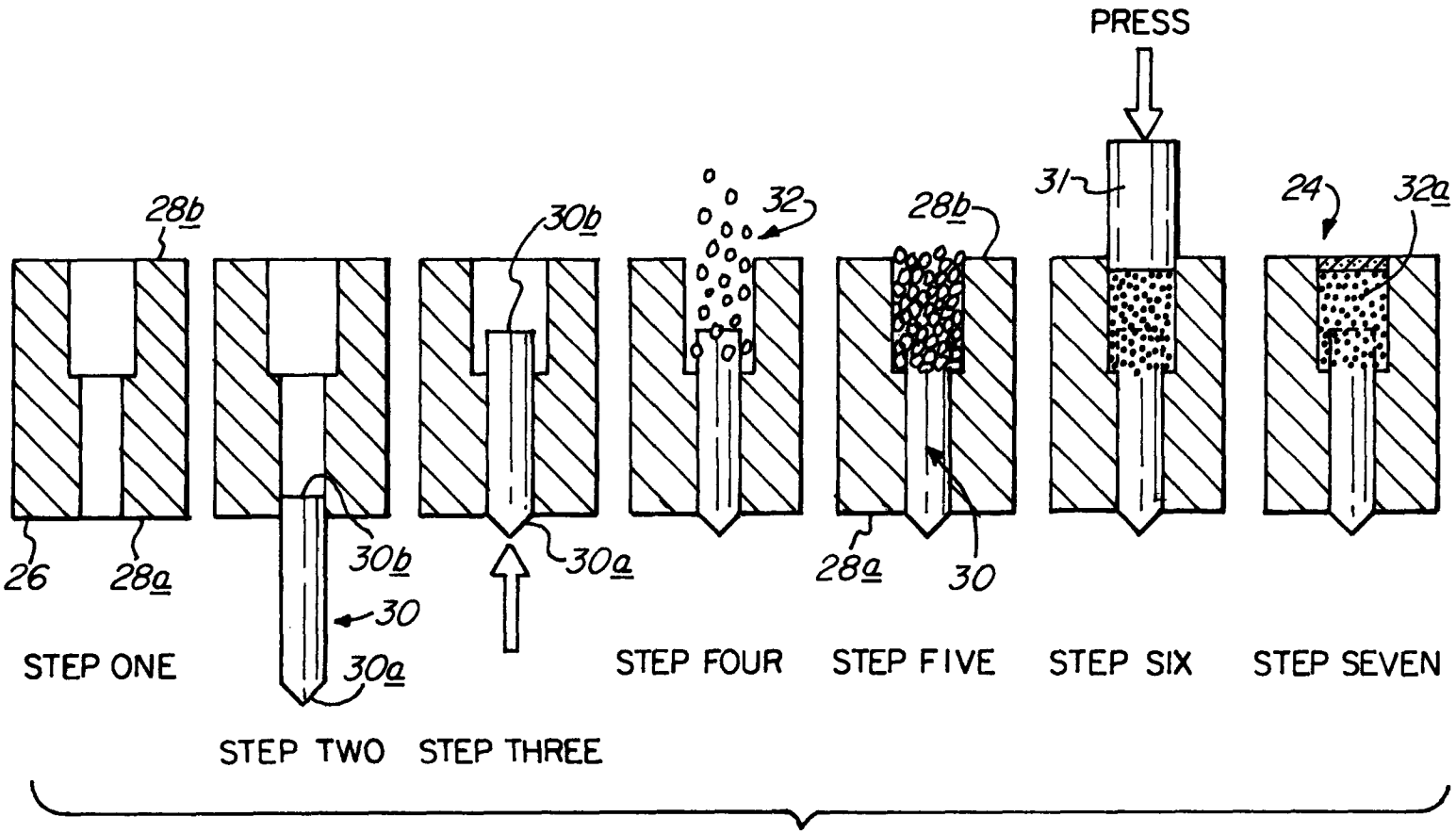
FIG. 4 is a series of schematic cross-sectional views of the sealer element of FIGS. 5 and 5A showing it in various stages of its manufacture.

FIG. 4 shows a sequence of manufacturing steps, labeled Step One through Step Seven, to manufacture sealer element 24 of FIG. 2A. A cylindrical, non-reactive sleeve 26 has extending therethrough a channel 28 comprised of a strip section 28*a* and a transfer charge section 28*b*. As best seen in FIG. 2A-1, strip section 28*a* is of rectangular configuration in cross section and, as best seen in FIG. 2A-2, transfer charge section 28*b* is of circular configuration in cross section.

In Step Two, a reactive material strip 30 is inserted into strip section 28*a* of channel 28 only far enough so that, as seen in Step Three, an input end 30*a* thereof protrudes from input face 26*a* of sleeve 26. Reactive material strip 30 is made pointed at one end 30*a* thereof, to facilitate insertion of end 30*a* into a reactive material such as a pyrotechnic delay material, e.g., material 16*b* of FIG. 2. This is an alternate form of construction of sealer 24 of FIG. 2. Strip section 28*a* and reactive material strip 30 are each dimensioned to provide a gas-tight and secure seating of reactive material strip 30 within non-reactive sleeve 26. The output end 30*b* of reactive material strip 30 protrudes into charge section 28*b* to insure good contact between strip 30 and transfer charge 32. In Step Four, a granulated pyrotechnic composition 32 comprising a transfer charge is inserted into transfer charge section 28*b* of sleeve 26. As shown in Step Five, transfer charge section 28*b* is filled with the material which is pressed as shown in Step Six to provide a compacted material 32'. When emplaced within shell 11 of detonator 110 as illustrated in FIG. 2, the protruding end 30*a* of reactive metal strip 30 is disposed to be inserted into a reactive material such as the column of compressed pyrotechnic material 16*b* in FIG. 3. The opposite end 28*b* of sealer element 24 will be initiated by the signal or "spit" emanating from terminal end 12*a* of shock tube 12 (FIG. 3), and will transfer the signal to sealer 24, then to delay element 16, then to output explosive charge 20 via reactive material strip 30 and output transfer charge 32.

Figures 2, 5A:
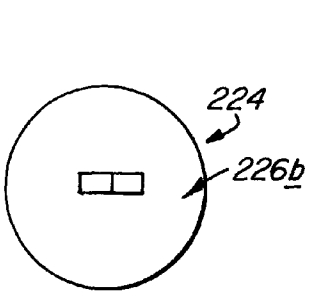
FIG. 5A is a longitudinal cross-sectional view, enlarged relative to FIG. 5, of the sealer element of the detonator of FIG. 5.
Figure 5A:
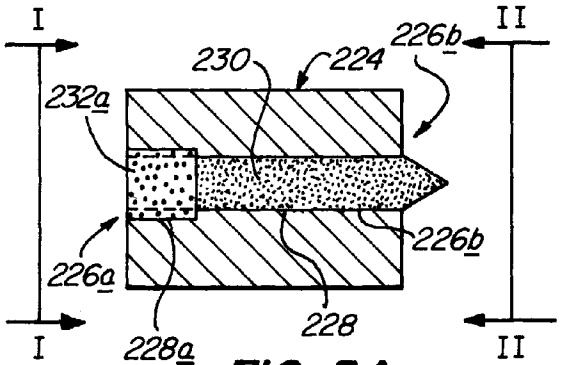
Figures 1, 5A:
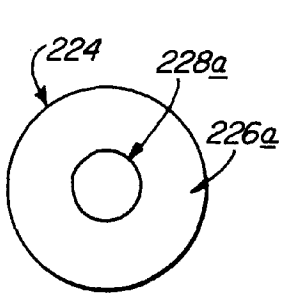

Referring now to FIGS. 5 and 5A, detonator 310 is identical to detonator 110 of FIG. 2 except that it contains a sealer element 224 which differs from the sealer element 24 of FIGS. 2 and 2A in that its transfer charge 232 is disposed at the input end of sealer element 224 and its reactive material strip 230 is pointed at its output end 230*a*. Sealer element 224 may be manufactured by the steps schematically illustrated in FIG. 4. Pointed end 230*a* penetrates into the compressed column 16*b* of pyrotechnic delay material. In detonator 310, reactive material strip 130 connects its input transfer charge 232*a* directly to column 16*b* of pyrotechnic material by penetrating the latter. Reactive material strip 230 may be similar to reactive material strip 30 of FIG. 2A in that the reactive material thereon may be a reactive multilayer laminate or a printed fuel-oxidizer strip or any other suitable self-sustaining reactant. As is the case with reactive material strip 30 of FIG. 2A, the reactive material may be disposed on one or both sides of the substrate. In this case, as seen in FIG. 5A, non-reactive sleeve 224, which has an input face 226*a* and an output face 226*b*, has formed therein a channel 228 which has an input section 228*a* and an output section 228*b*. As seen in FIGS. 5A-1 and 5A-2, respectively, input section 228*a* is cylindrical in cross section and output section 228*b* is rectangular in cross section. Input section 228*a* and output section 228*b* of channel 228 may be connected by a rectangular slit or rectangular channel (unnumbered) into which reactive material strip 230 is inserted in order that reactive material strip 230 connects sections 228*a* and 228*b* to each other in signal transfer communication.

Figure 5C:
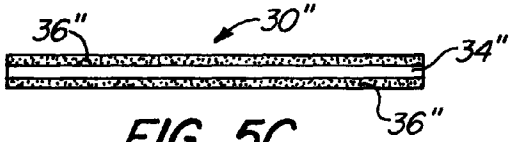
FIG. 5C is an elevation view of a multi-path reactive material in accordance with an embodiment of the present invention.
Figure 5B:
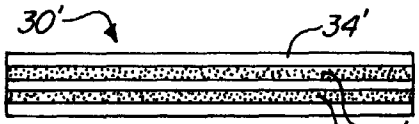
FIG. 5B is a plan view of a multi-path reactive material in accordance with an embodiment of the present invention.

For the sake of redundancy, multiple travel paths along the reactive material may, as shown in FIGS. 5B and 5C, be provided. FIG. 5B shows a reactive strip 30' comprising a substrate 34' on which two strips of reactive material 36' are disposed. FIG. 5C shows a reactive strip 30" having bands 36" of reactive material on each opposite side of the substrate 34". Multiple bands of reactive material may be applied on one or both sides of the substrate. However, all the bands of reactive material are disposed in parallel to each other and not in series between the input and output ends.

In use, the signal generated in shock tube 12 travels to terminal end 12*a* thereof (FIG. 5) and initiates input transfer charge 232*a* (FIG. 5A) which in turn initiates reactive material strip 230, which in turn initiates delay element 16 (FIG. 5), which in its turn initiates output explosive charge 20. As with the other embodiments of the invention, even if the reaction residue of transfer charge 232*a* does not provide a perfect gas seal, the reaction residue of reactive material strip 230 does, as it comprises a metal substrate and a thin coating of a solid, non-porous reaction residue.

Figures 6A, 6B:
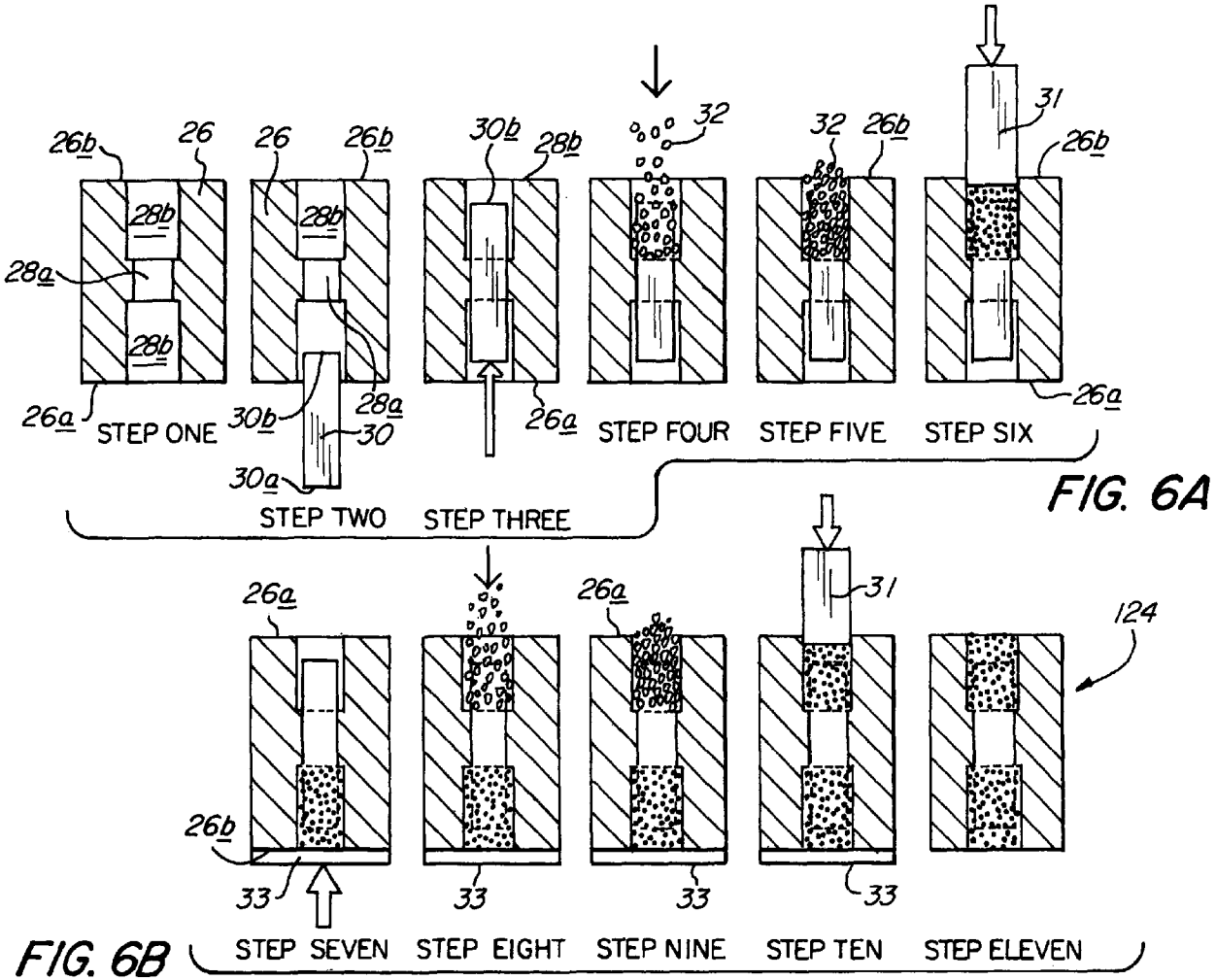
FIG. 6A is a series of schematic cross-sectional views of the sealer element of FIGS. 3 and 3A showing it in the early steps of its manufacture.
FIG. 6B is a schematic view of the latter steps of the manufacturing sequence whose early steps are shown in FIG. 6A.

Referring now to FIGS. 6A and 6B, there is shown the sequence of manufacturing of sealer element 124 of FIG. 3A. There is provided in Step One a non-reactive sleeve 126 which is identical to that pictured in FIG. 3A and has an input face 126*a* and an output face 126*b*. In Step Two, reactive material strip 30 is inserted into strip section 128*a* and, as shown in Step Three, is pressed further into cylindrical sleeve 126 than is the case in the embodiment of FIG. 4. In this case, reactive material strip 30 is pushed into non-reactive sleeve 26 sufficiently to recess the input end 30*a* within sleeve 26 so that it does not protrude therefrom. The output end 30*b* of strip 30 is pushed farther into charge section 28*b* than is the case in the embodiment of FIG. 4. Steps Four, Five and Six of FIG. 5A are the same as Steps Four, Five and Six of the FIG. 4 embodiment, i.e., the transfer charge section is filled with an input transfer charge 32 and, in Step Six, is compressed by a tool 31.

Referring now to FIG. 6B, in Step Seven, sleeve 26 has been reversed or flipped over from its orientation shown in FIG. 6A, so that the respective positions of input face 26*a* and output face 26*b* are reversed relative to their positions in Steps One through Six. Steps Eight, Nine and Ten are then carried out to fill section 28*a* with transfer charge 132 which is compacted by tool 31 as shown in Step Ten. In addition, during Steps Seven through Ten, a tool 33 is positioned to hold the transfer charge 32 in section 28*a* in place. Both transfer charges 32 and 132 may optionally be sealed off by application of a lacquer, wax or other suitable material to the end of each transfer charge 32, to provide seals 32' to maintain transfer charges 32 in place. In lieu of a granulated pyrotechnic material 32, a liquid precursor of a pyrotechnic transfer charge may be disposed at one or both ends of the sealer element and cured or dried to form a transfer charge.

In use, the signal from shock tube 12 (FIG. 3) initiates transfer charge 32 which in turn initiates reactive material strip 30 which in turn initiates transfer charge 132 to initiate output explosive charge 20.

Figure 7:
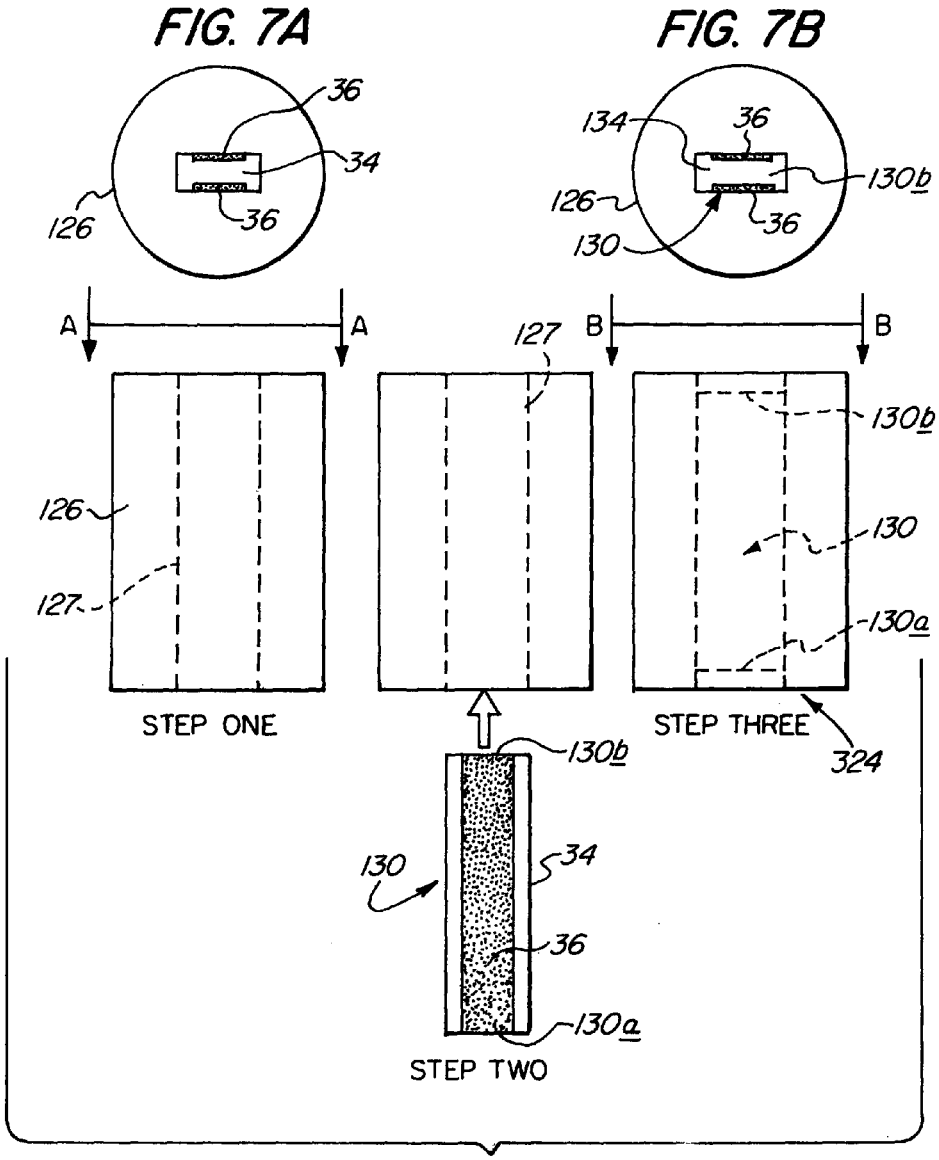
FIG. 7 is a series of schematic cross-sectional views of a sealer element in accordance with a fourth embodiment of the present invention showing it in three stages of its manufacture.

FIG. 7 illustrates manufacturing Steps One through Three schematically showing the manufacture of a sealer element 324 utilizing reactive strip 130 which is rectangular in plan view, and therefore transversely straight at both its input end 130*a* and its opposite, output end 130*b* to provide enhanced surface area to carry an enhanced amount of reactive material at both ends 130*a*, 130*b*. Reactive strip 130 is comprised of a substrate 34 on which is disposed a band 36 of reactive material. Band 36, which for redundancy may optionally be disposed on each side of substrate 34 as illustrated in FIGS. 7A and 7B, has a straight-line configuration to decrease the burning time from input end 130*a* to output end 130*b*. The side or sides of substrate 34 on which band 36 is disposed may be laminated, for example, by being covered with tape, to protect band 36. Cylindrical, non-reactive sleeve 126 has a chamber 127 formed therein through which reactive strip 130 is forced so that each opposite end 130*a* and 130*b* thereof is recessed within cylindrical sleeve 124 to protect the opposite ends of the band 36 of reactive material.

As disclosed in published U.S. patent application 2006/0236887 A1, reactive band 36 may be applied by printing or any other suitable means to a substrate 34, which is preferably aluminum or similar metal. The "ink" from which band 36 is printed may comprise a fuel and oxidizer material such as that described above. Alternatively, band 36 may be applied in two layers or in a series of alternating layers of oxidizer and fuel, as is also disclosed in U.S. patent application 2006/0236887 A1. The reactive material band 36 is made wide enough to ensure a sufficient caloric output to assure initiation of delay element 16 which in turn initiates output explosive charge 20. Optionally, the entire surface of substrate 34 may be coated with reactive material 36 and, as noted above, if desired, both sides of substrate 34 may be so coated with reactive material 36, which may also comprise a multi-layer of unalloyed metal foils as described above, or any other suitable reactive material.

The tight fit of the cylindrical sleeve of the sealer element of the present invention within the shell 11 of a detonator 10 prevents gas leakage between the outside of the sleeve and the interior of the shell 11. The reactive strip 130 includes a substrate which effectively seals the channel 127 even after reaction of the multilayer metal laminate or printed reactive band, thereby maintaining a constant pressure within the core of the delay element 16.

While the invention has been described in connection with specific embodiments thereof, it will be appreciated that other embodiments may be devised which lie within the scope of the present invention and the appended claims.

What is claimed is:

1. In a sealer element for a device comprising an energy source and a pyrotechnic delay train, the sealer element having an input end and an output end and comprising a reactive material;

the improvement comprising that the sealer element comprises a strip of reactive material defining at least one reaction path extending in a straight line for the entire distance from the input end to the output end, the reactive material being accessible for signal transfer communication at both the input end and the output end, the sealer element being configured to be disposed between such energy source and such pyrotechnic delay train, with the output end of the sealer element being in signal transfer communication with such pyrotechnic delay train, the reactive material comprises a solid material comprised of at least two different materials which, upon being energized, react with each other in an exothermic and self-sustaining reaction to generate a reaction product, and the reaction product is impermeable to gas flow therethrough including combustion gases generated by ignition and burning of the pyrotechnic delay train.

2. In a sealer element for a device comprising an energy source and a pyrotechnic delay train, the sealer element having an input end and an output end and comprising a reactive material, the sealer element further being configured to be disposed within such device;

the improvement comprising that the sealer element comprises a strip of reactive material defining at least one reaction path extending in a straight line for the entire distance from the input end of the sealer device to the output end of the sealer device, whereby upon the reactive material being energized by the energy source the reactive material reacts along the reaction path to leave a residual reaction product along the reaction path, the sealer element being configured to be disposed between such energy source and such pyrotechnic delay train with the output end of the sealer element being in signal transfer communication with such pyrotechnic delay train, the reactive material comprises a solid material comprised of at least two different materials which, upon being energized, react with each other in an exothermic and self-sustaining reaction, the reaction product is impermeable to combustion gases generated by ignition and burning of such pyrotechnic delay train, and the sealer element is otherwise configured to provide a gas-impermeable seal which prevents passage of such combustion gases back past the sealer element.

3. The sealer element of claim 1 or claim 2 wherein the improvement further comprises that the reactive material comprises at least two different metals disposed in contact with each other and which, upon being energized by the energy source, react with each other to form an alloy of the at least two different metals.

4. The sealer element of claim 3 wherein the improvement further comprises that the at least two different metals are arranged in a plurality of alternate layers of the different metals.

5. The sealer element of claim 4 wherein the improvement further comprises that the alternate layers comprise a reactive multilayer foil laminate.

6. The sealer element of claim 1 or claim 2 wherein the improvement further comprises that the reactive material comprises a solid dried or cured ink-like composition containing an intimate admixture of a particulate fuel and a particulate oxidant.

7. The sealer element of claim 1 or claim 2 wherein the improvement further comprises that the reactive material is supported on a substrate.

8. The sealer element of claim 1 or claim 2 wherein the improvement further comprises that the sealer element further comprises a plug encapsulating the reactive material with only end portions of the reactive material exposed at, respectively, the input end and the output end of the sealer element.

9. The sealer element of claim 1 or claim 2 wherein the improvement further comprises that the sealer element further comprises a plug encapsulating the reactive material, the plug having an output transfer charge disposed at the output end of the sealer element in signal transfer communication with the reactive material, and a portion of the reactive material is exposed to such energy source at the input end.

10. The sealer element of claim 1 or claim 2 wherein the improvement further comprises that the sealer element further comprises a plug encapsulating the reactive material, the plug having an input transfer charge disposed at the input end of the sealer element and in signal transfer communication with the reactive material, and an output transfer charge at the output end of the sealer element which output charge is in signal transfer communication with the reactive material.

11. The sealer element of claim 1 or claim 2 wherein the improvement further comprises that the reactive material protrudes from the output end of the sealer element to provide a protruding end of the reactive material.

12. The sealer element of claim 11 wherein the improvement further comprises that the protruding end comprises a pointed, rigid end of the reactive material.

13. The sealer element of claim 1 or claim 2 wherein the improvement further comprises that the sealer element further comprises a plug encapsulating the reactive material, the plug having an output transfer charge disposed at the output end of the sealer element and in signal transfer communication with the reactive material, and a portion of the reactive material is exposed to the energy source at the output end.

14. The sealer element of claim 1 or claim 2 wherein the improvement further comprises that the reactive material defines a plurality of reaction paths disposed in parallel with each other.

15. In a device containing an ignition source, a pyrotechnic delay train and a sealer element interposed between the ignition source and the delay train, the improvement comprising that the sealer element is the sealer element of claim 1 or claim 2.

16. The device of claim 15 wherein the output end of the sealer element is in abutting contact with the pyrotechnic delay train.

* * * * *